United States Patent [19]

Pullman

[11] Patent Number: 4,884,177

[45] **Date of Patent: * Nov. 28, 1989**

[54] FLEXIBLE TORCH

[76] Inventor: Burke C. Pullman, Appt. 19G, 939, Coast Blvd., La Jolla, Calif. 92037

[ * ] Notice: The portion of the term of this patent subsequent to Apr. 19, 2005 has been disclaimed.

[21] Appl. No.: 154,595

[22] Filed: Feb. 11, 1988

[30] Foreign Application Priority Data

Feb. 13, 1987 [GB] United Kingdom ..... 8703342

[51] Int. Cl.[4] ..... F21L 7/00

[52] U.S. Cl. ..... 362/189; 362/135

[58] Field of Search ..... 362/157, 189, 196, 200, 362/135, 136, 140, 143

[56] References Cited

U.S. PATENT DOCUMENTS

| | | | |
|---|---|---|---|
| 4,433,365 | 2/1984 | Rousseau | 362/189 |
| 4,631,646 | 12/1986 | Spindler | 362/189 |
| 4,731,712 | 3/1988 | Amthon | 362/189 |
| 4,739,455 | 4/1988 | Pullman | 362/189 |
| 4,747,026 | 5/1988 | Rousseau | 362/189 |
| 4,768,138 | 8/1988 | Leopoldi et al. | 362/189 |

*Primary Examiner*—Ira S. Lazarus
*Assistant Examiner*—Sue Hagarman
*Attorney, Agent, or Firm*—Young & Thompson

[57] ABSTRACT

A torch has a tray (1) for batteries and a mounting for a bulb (19). A cover (3,17) fits over this, confining the batteries and having a hole (20) into which the bulb projects. The material of the cover causes light to travel through it to a diffuser (21) which illuminates a zone out of the direct beam of the bulb. A mirror (16) fixed to the tray or to the cover adjacent the diffuser may be used with the diffused light as the sole source of illumination. The cover may have discontinuities elsewhere (18) which will show graphics or pictorial design illuminated by light diffused through the cover. The cover may be of J form, the hooked portion having the bulb hole (20) centrally and the diffuser (21) at its extremity, while the long limb (18) may carry the discontinuities. A switch for the torch is provided by a slider (8) captive to a side of the tray (1) and co-operative with the cover (3) to deform that side as it moves, to make and break an internal contact.

11 Claims, 3 Drawing Sheets

FLEXIBLE TORCH

Figure 1:
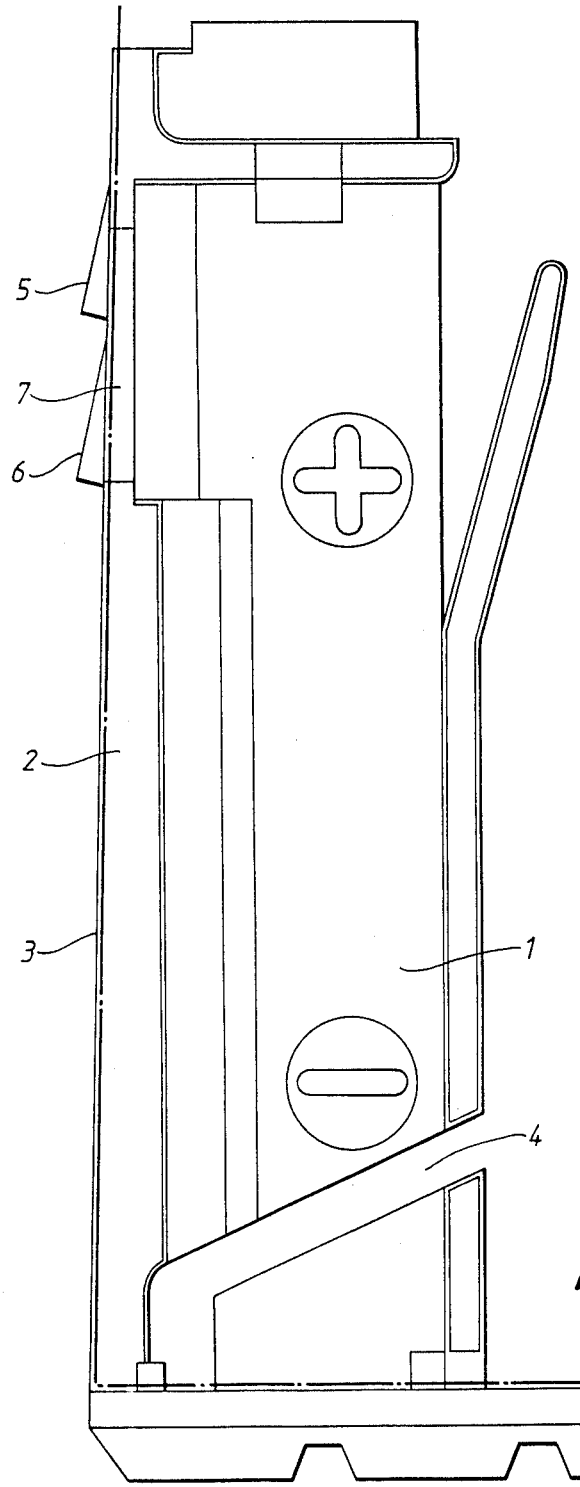

This invention relates to torches. It is a development of that described in U.S. Pat. No. 4,739,455.

In that earlier patent there is described a torch with a tray adapted to receive a battery or batteries and to locate a bulb, and a U-shaped cover which fits over the tray to confine the battery or batteries, the bulb projecting through an aperture in the web of the U, and the cover being of translucent plastics material through which light from the bulb diffuses to illuminate the backing material beneath.

The switching arrangement on that torch relies on a side of the tray, exposed within the bight of the U-shaped cover, being deformable to make the contact between the bulb and the battery or batteries. The torch was simply squeezed to switch on and relaxed to switch off. However, the scale of the torch made this rather awkward and inconvenient, and it is now preferred to resort to a normal switch.

It is one aim of this invention to provide this, without departing fundamentally from the previous construction of the torch.

Other drawbacks of that earlier torch have also become apparent. When a mirror was provided, there was too much emphasis on illuminating the mirror itself, rather than the user's face. Also, further effects could be obtained by discontinuities in the smooth surface of the cover. But it was undesirable to have these on the outside, where they would spoil the streamlined finish, and it was virtually impossible to form them on the inside, because of the U shape and consequent inaccessibility. Another point made by users of the mirrored version was that it was fine to have a mirror, but useless unless one also had the cosmetics or appliances to use with it.

The invention further aims to remedy these drawbacks.

According to one aspect of the present invention there is provided a torch having a tray adapted to receive battery means and to locate a bulb, a cover which fits over the tray to confine the battery means and over the bulb to define a zone of direct illumination by the bulb, a mirror mounted on one side of the torch, and light diffusion means, at least partially formed by said cover, whereby light from said bulb is shed towards another zone, facing said mirror, exclusive of the first zone.

The mirror may be on a cover-free portion of the tray, or it may be on the tray, beneath a transparent portion of the cover. Alternatively, it may be on the cover itself.

Preferably, the cover is generally J-shaped the hooked portion having an aperture into which the bulb projects. The light diffusion means may then be provided by discontinuities in the cover at the free edge part of the hooked portion.

According to another aspect of the present invention there is provided a torch having a tray adapted to receive battery means and to locate a bulb, a cover which fits over the tray to confine the battery means and over the bulb, the cover being of translucent plastics material, and surface deformations in a display area defined by the cover but not in direct line of illumination by light diffused through the cover from said bulb.

With the cover in the J-shape referred to, the display area will be on the long limb of the J, and the surface deformations will preferably be on the inside.

For switching the torch, a slider may be captive to a flexible side of the tray and have retaining means engaged with an edge formation of the cover. There will then be co-operating ramp means on the slider and tray which, on motion of the slider, causes said side portion to flex and thereby make or break an electrical contact in a battery/bulb circuit.

When a mirror is provided, another side of said body may have means for retaining a cosmetic item, such as a lipstick or an appliance such as a comb.

Figure 2:
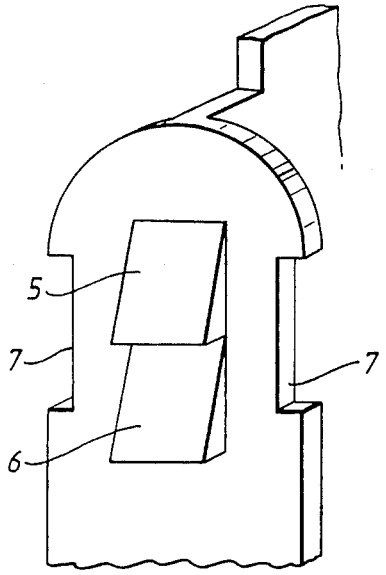
Figure 3:
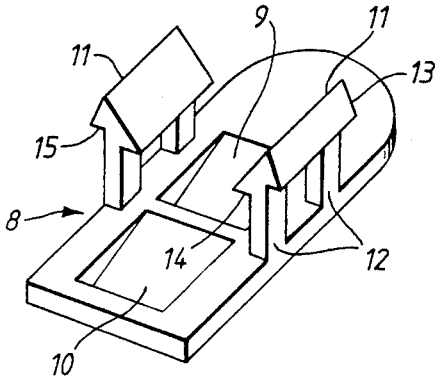
Figure 4:
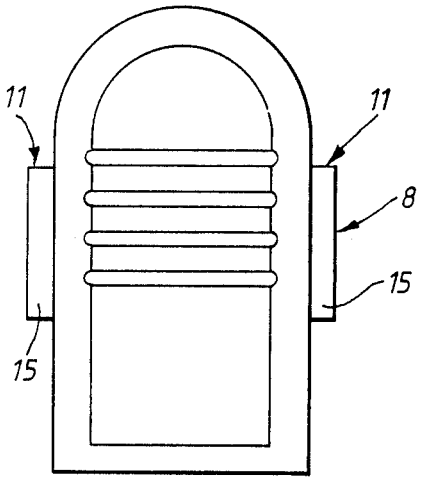
Figure 5:
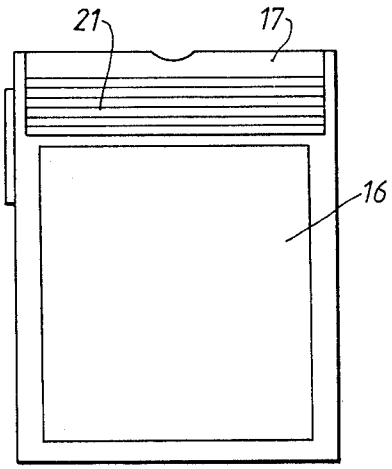
Figure 6:
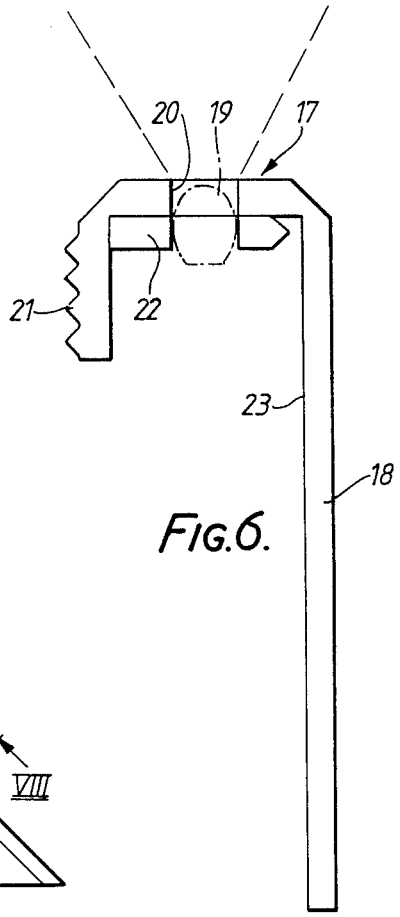
Figure 7:
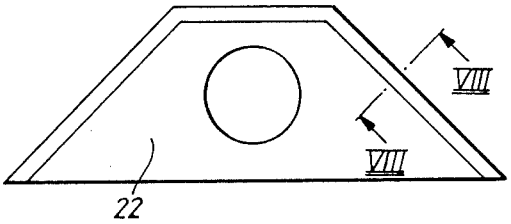
Figure 8:
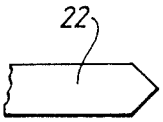

For a better understanding of the invention, one embodiment will now be described, by way of example, with reference to the accompanying drawings, in which:

FIG. 1 is a side view of part of the body of a torch,

FIG. 2 is a perspective view of the free end of a flexible switch portion of that body, FIG. 3 is a rear perspective view of a slider for fitting to the switch portion, FIG. 4 is a face view of the slider mounted on the switch portion, FIG. 5 is a face view of a torch, FIG. 6 is a longitudinal section of a cover assembly for the torch of FIG. 5, FIG. 7 is a plan view of part of that assembly, and FIG. 8 is a section on the line VIII—VIII of FIG. 7.

The torch is largely as described in U.S. Pat. No. 4,739,455 and will not be described in detail. The earlier torch was switched on by manually squeezing the sides of a battery tray exposed between the limbs of a U-shaped cover, part of the tray being arranged to flex inwardly and close a contact. A similar motion is generated here, but it is caused by a slider moved longitudinally of the side of the tray instead of the direct squeezing action, which was not particularly easy or comfortable.

Referring to FIG. 1, the tray has a battery compartment 1 at one side whose outer wall 2 is exposed between the limbs of the transparent cover 3, indicated in outline and assumed presently to be of the same U-form as in the earlier torch. Near the base, the compartment 1 is cut away at 4 so that it can flex inwardly, thus making an electrical contact.

Referring now to FIG. 2, the forward or free end of the wall 2 has two integrally moulded ramps 5 and 6 on its outer face, the thinner ends being towards the front of the torch and the steps being towards the base. The edges of the wall 2 are cut away on either side of the ramps to form shallow indents 7, and the base of the battery compartment 1 is also locally removed adjacent one of the indents.

A slider 8 as shown in FIG. 3 is mounted over this end portion of the wall 2. It has two aligned sloping recesses 9 and 10 in its inner face, inversely matching the ramps 5 and 6 which can fit snugly in them. On either side, the slider has catches 11, each comprising two pillars 12 projecting rearwardly and spanned by a profiled bridge 13. In cross section, this has a V-shaped apex pointing to the rear, and it provides two lips 14 and 15 on the inside and outside respectively of the pillars 12. The lips 14 are closer to the rear face of the slider 8, the distance being just slightly greater than the thickness of the wall 2 plus the maximum height of the ramps 5 and 6. The longitudinal extent of the catches 11 is about half the length of the indents 7, and they are spaced so that the slider, when positioned over the ramps 5 and 6, can be press fitted normal to the wall 2. The catches 11 are temporarily spread by the sloping inside surface of the bridges 13 engaging the indents 7, and then they snap back for the lips 14 to engage behind the wall 2. With the slider moved to its upper position towards the front of the torch, the ramps 5 and 6 register with the recesses 9 and 10 and so, without any other restraint, the slider is loose. But as it is moved towards the base, so the shallow ends of the recesses will come to engage the thicker portions of the ramps more positively.

However, this looseness exists in the absence of the transparent cover 3. When that is fitted, its inturned rim in the vicinity of the indents 7 provide ledges behind which the outer lips 15 of the cathes 13 engage. The height of the lips 15 in relation to the inner face of the slider 8 is such that the latter is held closely against the outer face of the wall 2 when the slider is in the upper position, with the ramps 5 and 6 fully engaged in the recesses 9 and 10. When the slider is shifted towards the base, the ramps 5 and 6 engage the sloping surfaces of the recesses 9 and 10 and the wall 2 is forced inwards, thus closing a contact within the torch. The angle of the ramps and the friction will be such that the slider will stay in this position when left untouched and will have to be positively returned to switch off the torch.

The outer sloping surfaces of the bridges 13 are provided so that the slider can be fitted with the cover in place, these sloping surfaces forcing the cover to spread slightly as the catches 11 snap past the wall 2. However, normally the slider will be fitted before the cover.

While a single ramp and matching recess might suffice, two are preferred for the stability of the slider.

Instead of the slider engaging the inside of the cover, it could instead engage the outside. The cover would have external ribs or rails along at least the edge portions in the region of the slider, and the latter would have flanges with internal projections to engage behind those ribs or rails. The ramp arrangement would still be provided, and movement of the slider would consequently cause the wall to flex in and out.

As mentioned above, the previous cover was U-shaped, and its limbs extended down the front and rear of the tray. A mirror could be fixed to one of those limbs, but an alternative arrangement is shown in FIGS. 5 to 8.

The rear of the tray is flat and has a mirror 16 bonded to it or a mirror surface formed directly on it. The snap-fit cover 17 does not extend over this; here it is J-shaped, hooking over the forward end of the torch and with its longer limb 18 extending down over the front of the tray in the manner of one limb of the previous cover. It could function similarly, to illuminate material trapped behind it and concealing the batteries. However, when all that is required is illumination for the mirror, it may be opaque. The bulb 19 does not project significantly into hole 20 in the cover, remaining well recessed for safety and for a less diffuse beam over a zone indicated by the broken lines.

The shorter limb of the J is thickened and serrated at 21 where it lies adjacent one edge of the mirror. This portion is translucent. A small plate 22 of translucent acrylic and apertured to fit around the bulb 19, is captive between the bight of the J and the forward end of the tray and "feeds" light towards the serrated portion 21. It is symmetrically trapezoidal in shape, and the shorter parallel side, which is towards the long limb side of the J, and the two inclined sides have a convex V section to throw light from the bulb back towards the longer parallel side, which is just behind the serrated portion 19.

When the torch is switched on, as well as the normal beam, the serrated portion 21 is brightly illuminated and casts diffused light laterally over a zone not impinged upon by the normal beam. For someone using the mirror 16 in close up, this is sufficient to illuminate an adjacent area, such as lips for applying lipstick, which will be clearly visible even if the torch is the only source of light.

Reverting to the longer limb of the J, if this too is used as a channel for light from the bulb, it can provide interesting effects without any backing material. The rear face 23 of this limb, when the cover is removed, is fully accessible, unlike the rear or inside faces of the previous symmetrical U-shaped cover. This enables moulding, etching, engraving or other surface treatment to be carried out that will be highlighted when the torch is switched on. For further enhancement, the depressions may be inked in various colours. Words and/or pictures may be "brought to life" in this way.

In a further embodiment (not shown), there are two J-shaped covers whose hooked portions overlap around the bulb and whose long limbs extend down opposite faces of the tray. Each of these can have their inner surfaces treated in the manner just described, or one of them may be transparent and simply cover a mirror on the tray, or itself carry the mirror, illumination for the mirror being as described above.

Alternatively, since a mirror is most likely to be used for cosmetic purposes, when that is provided, the non-mirror side may have means for holding a cosmetic item, such as a lipstick, or implement such as a comb. This may simply be a wide elasticated band, or two narrower ones. A more complex arrangement is to have a clip moulded integrally with the cover, or attached thereto.

What is claimed:

1. A torch having a tray adapted to receive battery means and to locate a bulb, a cover which fits over the tray to confine the battery means and over the bulb to define a zone of direct illumination by the bulb, a mirror mounted on one side of the torch, and light diffusion means, at least partially formed by said cover, whereby light from said bulb is shed towards another zone, facing said mirror, exclusive of the first zone.

2. A torch as claimed in claim 1, wherein said mirror is on a cover-free portion of the tray.

3. A torch as claimed in claim 1, wherein said mirror is on the tray, beneath a transparent portion of the cover.

4. A torch as claimed in claim 1, wherein the mirror is on the cover.

5. A torch as claimed in claim 1, wherein the cover is generally J-shaped, the hooked portion having an aperture into which the bulb projects.

6. A torch as claimed in claim 5, wherein the light diffusion means is provided by discontinuities in the cover at the face edge part of the hooked portion.

7. A torch having a tray adapted to receive battery means and to locate a bulb, a cover which fits over the tray to confine the battery means and over the bulb, the cover being of translucent plastics material, and surface deformations in a display area defined by the cover but not in direct line of illumination by said bulb, such deformations being illuminated by light diffused through the cover from said bulb.

8. A torch as claimed in claim 7, wherein the cover is generally J-shaped, the hooked portion having an aperture into which the bulb projects, the display area being on the long limb of the J.

9. A torch as claimed in claim 6, wherein the surface deformations are on the inside surface.

10. A torch as claimed in claim 1, having a slider captive to a flexible side of the tray with retaining means engaged with an edge formation of the cover, there being co-operating ramp means on the slider and tray which, on motion of the slider, causes said side portion to flex and thereby make or break an electrical contact in a battery/bulb circuit.

11. A torch as claimed in claim 1, wherein another side of said body has means for retaining a cosmetic item, such as a lipstick, or an appliance such as a comb.

* * * * *